United States Patent [19]

Mayer et al.

[11] Patent Number: 4,876,996

[45] Date of Patent: Oct. 31, 1989

[54] DEVICE FOR THE VALVE CONTROL GEAR OF AN INTERNAL COMBUSTION ENGINE

[75] Inventors: Ernst Mayer, Grossenseebach; Norbert Geheeb, Bamberg; Uwe Köhler, Aidlingen, all of Fed. Rep. of Germany

[73] Assignee: INA Walzlager Schaeffler KG, Fed. Rep. of Germany

[21] Appl. No.: 319,957

[22] Filed: Mar. 7, 1989

[30] Foreign Application Priority Data

Mar. 23, 1988 [DE] Fed. Rep. of Germany ..... 3809702

[51] Int. Cl.[4] ..... F01L 3/04; F01L 1/14; F01L 1/16

[52] U.S. Cl. ..... 123/90.51; 29/156.7 B

[58] Field of Search ..... 123/90.51, 90.55, 90.56, 123/90.57; 29/156.7 B

[56] References Cited

U.S. PATENT DOCUMENTS

| | | | |
|---|---|---|---|
| RE. 32,167 | 6/1986 | Buente | 123/90.51 |
| 3,131,470 | 5/1964 | Waller | 123/90.51 |
| 3,545,415 | 12/1970 | Mori | 123/90.51 |
| 4,230,491 | 10/1980 | Behnke | 123/90.51 |
| 4,367,701 | 1/1983 | Buente | 123/90.51 |
| 4,688,526 | 8/1987 | Buente et al. | 123/90.58 |
| 4,829,950 | 5/1989 | Kanamaru et al. | 123/90.51 |

*Primary Examiner*—Willis R. Wolfe
*Assistant Examiner*—Weilun Lo
*Attorney, Agent, or Firm*—Bierman and Muserlian

[57] ABSTRACT

A device for the valve control gear of an internal combustion engine including a surface of which acts as a stop face for a cam. The surface is chromium coated.

6 Claims, 1 Drawing Sheet

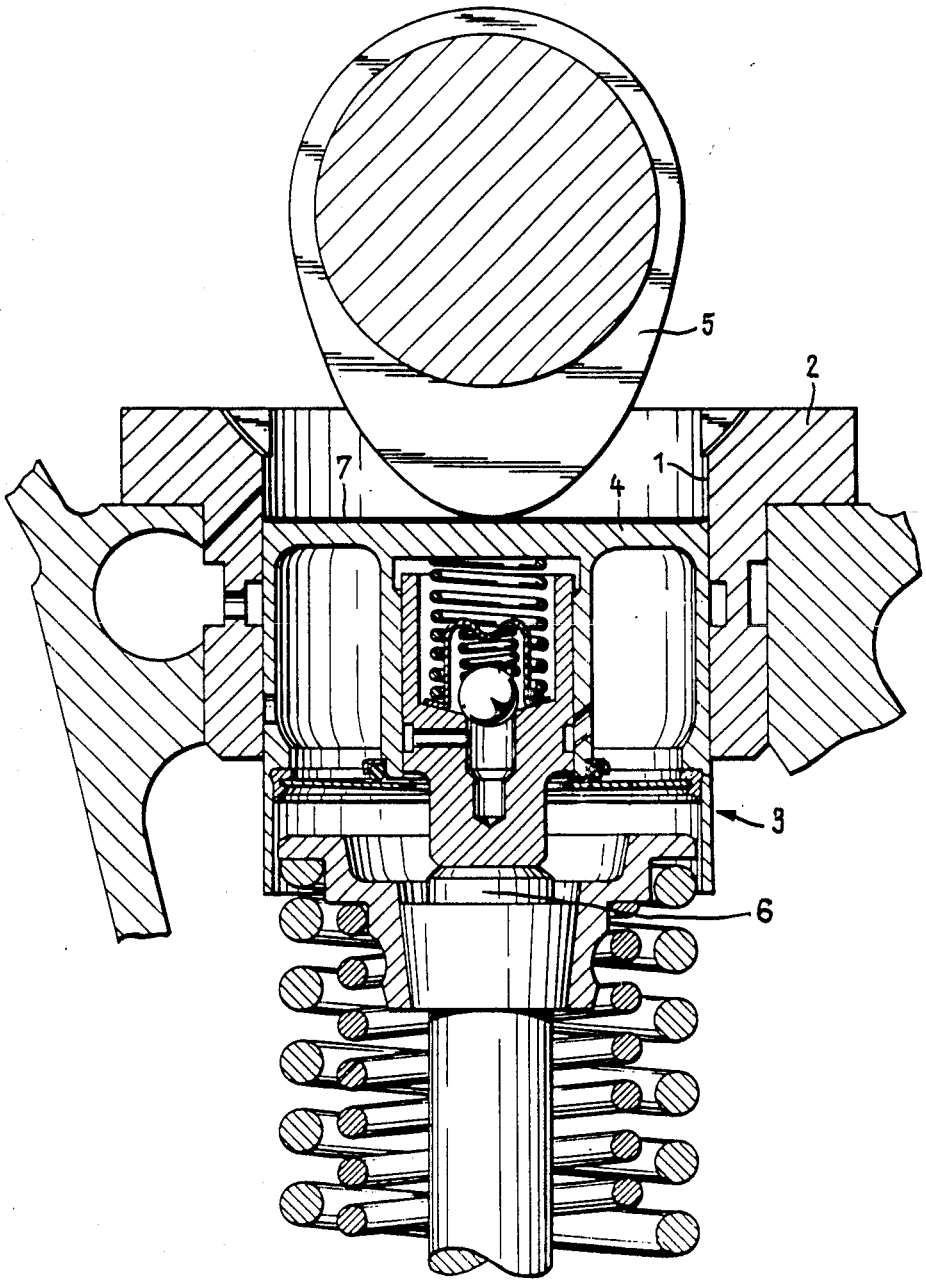
5
2
7
1
4
3
6

DEVICE FOR THE VALVE CONTROL GEAR OF AN INTERNAL COMBUSTION ENGINE

STATE OF THE ART

In such known devices and especially in cup tappets which are used frequently at the present, a heavy wear of the stop face against which the cam moves is observed even under favorable lubrication conditions. Efforts to prevent this wearing process consist, for example, in phosphatizing or cadmiumplating the surface to improve its sliding properties. However, the success of these methods is very limited, especially with regard to durability. Attempts were also made to reduce the wear by hard-chrome plating the stop face since hard-chrome coatings are known to possess very favorable properties with regard to wear.

For this, hard-chrome coatings of a proven thickness of 10 μm and more were applied. The relevant literature recommends layer thicknesses from 10 μm up to several mm for hard-chrome coatings ("Galvanisierte Produkte" Gutesicherung RAL-RG 660, Part 1 and Part 2, Published November 1986, Deutsches Institut fur Gutesicherung und Kennzeichnung). This otherwise successful surface treatment did not result in a success as applied in practice since the chromium layer peels off after a relatively short operation time, thus additionally accelerating the wear process. The reason for the peeling off of the chromium layer is that under operating conditions, the surface to which it is applied, especially the bottom of cup tappets, undergoes deflections of a magnitude which known hard-chrome coatings cannot withstand witout damage which results in cracks and peelings.

OBJECTS OF THE INVENTION

It is an object of the invention to provide a surface coating for such devices which not only leads to favorable wear behavior but also high fatigue bending and compressive strength, thus enabling a long operating time of the device to be attained.

This and other objects and advantages of the invention will become obvious from the following detailed description.

BRIEF DESCRIPTION OF THE DRAWING

The sole FIGURE is a cross-sectional view of a hydraulic tappet showing the chromium coating on the stop face.

THE INVENTION

According to the invention, this object is attained in that the stop face of the device against which the cam moves is provided with a chromium coating with a maximum thickness of 5 μm, and preferably 2.5 μm. Practical experience has shown that at locations where forces are applied, such a thin layer is able to carry the deformations and compressive stresses acting on the device and especially on the bottom of a cup tappet without negative influence on the life of the chromium coating. On the contrary, operating times were established in tests which were substantially longer than those reached with conventional cup tappets without surface treatment.

In a preferred embodiment, the chromium coating has several layers applied one after the other wherein at least the last or outer layer which forms the sliding surface for the cam has micro-cracks. The presence of these micro-cracks in which lubricant can accumulate has proved to be of great importance for the sliding properties at the surface of the chromium coating. For the durability of the chromium coating on the other hand, it is of essential importance that the first layer which establishes a bond with the material of the device is free from micro-cracks to prevent micro notch effects and thus the formation of starting points for a possible peeling off of the coating. In a further preferred embodiment, the last layer applied contains at least 600 cracks/cm.

A preferred method of applying the micro-crack-free first layer is electrolytic metal deposition with a current density of approximately 15 $A/dm^2$ whereas the last layer containing at least 600 cracks/cm can be electrolytically applied with a current density of less than 15 $A/dm^2$.

To reduce the danger of damage to the base material caused by hydrogen, it is expedient to heat the chromium coated structural member after electroplating and maintain the temperature at about 120° C. for four hours before letting it air-cool.

All of the above is more fully explained in the detailed description of a preferred form of the invention illustrated in the accompanying FIGURE. The FIGURE shows a valve gear with a cup tappet in longitudinal cross-section.

In a bore 1 of the cylinder head , the cup tappet 3 containing as is known an hydraulic valve clearance compensating element is mounted in a longitudinally displaceable manner. The level bottom 4 of the cup tappet 3 acts as the stop face for the cam 5 whereas on the other side, the cup tappet abuts on the shaft 6 of a control gear. The bottom 4 of the cup tappet 3 is provided in accordance with the invention with a chromium coating 7.

Various modifications of the device of the invention may be made without departing from the spirit or scope thereof and it is to be understood that the invention is intended to be limited only as defined in the appended claims.

What we claim is:

1. A device for the valve control gear of an internal combustion engine a surface of which acts as a stop face for a cam, characterized in that a chromium coating is applied to the stop face, the maximum thickness of this coating being 5 μm.

2. A device of claim 1 which is a cup tappet.

3. A device of claim 1 wherein the chromium coating comprises several consecutively applied layers whereby at least the last layer has micro-cracks.

4. A device of claim 3 wherein the last layer applied has at least 600 cracks/cm.

5. A device of claim 1 wherein at least the first layer, applied directly to the material of the device, is substantially free from micro-cracks.

6. A device of claim 1 wherein the maximum coating thickness is 2.5 μm.

* * * * *